US007444214B2

(12) United States Patent
Cho et al.

(10) Patent No.: US 7,444,214 B2
(45) Date of Patent: Oct. 28, 2008

(54) OBSTACLE DETECTION APPARATUS, METHOD AND MEDIUM

(75) Inventors: Woo-jong Cho, Yongin-si (KR); Dong-yoon Kim, Yongin-si (KR); Seong-il Cho, Yongin-si (KR); Sung-mun Cho, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/634,982

(22) Filed: Dec. 7, 2006

(65) Prior Publication Data

US 2007/0273864 A1 Nov. 29, 2007

(30) Foreign Application Priority Data

May 23, 2006 (KR) ..... 10-2006-0046217

(51) Int. Cl.
*G01C 22/00* (2006.01)

(52) U.S. Cl. ..... 701/23; 701/17; 701/72; 701/80; 701/91; 701/301; 700/245; 700/250; 700/255; 700/258

(58) Field of Classification Search ..... 356/28; 700/245, 250, 255, 258; 701/71, 72, 80, 701/91, 301, 23

See application file for complete search history.

(56) References Cited

U.S. PATENT DOCUMENTS

2005/0171639 A1* 8/2005 Uehigashi et al. ..... 700/245

FOREIGN PATENT DOCUMENTS

| | | |
|---|---|---|
| JP | 2005-211462 | 8/2005 |
| KR | 1996-0013853 | 5/1996 |
| KR | 10-2004-0086937 | 10/2004 |

* cited by examiner

*Primary Examiner*—Thomas H. Tarcza
*Assistant Examiner*—Timothy A Brainard
(74) *Attorney, Agent, or Firm*—Staas & Halsey LLP

(57) ABSTRACT

An obstacle detection apparatus and method which can detect the state of an obstacle according to a signal generated when the obstacle detection apparatus collides with the obstacle and a change in the posture of the obstacle detection apparatus caused due to the collision with the obstacle. The obstacle detection apparatus includes a main body which can be moved along the surface of the ground, a movement amount determination module which determines whether the amount of movement of the main body is outside a predefined threshold range, a posture determination module which determines the changed posture of the main body with respect to the surface of the ground according to the amount of movement of the main body, and a state determination module which determines the state of an obstacle based on the results of determination of the movement amount determination module or the posture determination module.

30 Claims, 7 Drawing Sheets

OBSTACLE DETECTION APPARATUS, METHOD AND MEDIUM

CROSS-REFERENCE TO RELATED APPLICATIONS

This application claims priority from Korean Patent Application No. 10-2006-0046217 filed on May 23, 2006 in the Korean Intellectual Property Office, the disclosure of which is incorporated herein by reference in its entirety.

BACKGROUND OF THE INVENTION

1. Field of the Invention

The present invention relates to an obstacle detection apparatus, method, and medium. More particularly, to an obstacle detection apparatus, method and medium which can detect the state of an obstacle according to a signal generated when the obstacle detection apparatus collides with the obstacle and a change in the posture of the obstacle detection apparatus caused due to the collision with the obstacle.

2. Description of the Related Art

Various types of robots such as robots capable of doing various household chores for users while autonomously moving around in homes have been developed. It is very important for such robots to determine their locations. Thus, a variety of methods have been suggested to enable robots to precisely determine their locations.

Cleaning robots suck up dirt and dust while traveling in a region. It is important for cleaning robots to determine not only their locations but also the locations and shapes of obstacles. In other words, cleaning robots control their suction force or traveling path by determining the locations and shapes of obstacles.

Conventionally, an optical triangulation method has been widely used to determine the location and shape of an obstacle. According to the optical triangulation method, the location and shape of an obstacle can be determined by emitting light with the aid of a light emitter and detecting the amount of light reflected from the obstacle with the aid of a light receptor. The optical triangulation method is based on the fact that the angle of reflection varies according to the distance to an obstacle and a variation in the angle of reflection reduces the amount of light incident on a light receptor or varies a focal point.

The optical triangulation method is robust against noise, and can detect various shapes of obstacles in different locations according to the arrangement of a light receptor and a light emitter.

However, the optical triangulation method may provide distorted measurement results according to the efficiency of reflection on the surface of an obstacle, and is only a one-point measurement method. For example, when the surface of an obstacle is like the surface of a mirror so that the obstacle scatters light only weakly, when the surface of the obstacle is rugged so that the obstacle scatters light irregularly, or when the obstacle is formed of a material that absorbs light and thus does not reflect light, measurement results obtained using the optical triangulation method may be erroneous.

Therefore, it is necessary to develop methods to determine the location and shape of an obstacle regardless of the texture of the surface of the obstacle.

SUMMARY OF THE INVENTION

Accordingly, an aspect of the present invention provides an obstacle detection apparatus and method which can determine the state of an obstacle according to a signal generated when the obstacle detection apparatus collides with the obstacle and a change in the posture of the obstacle detection apparatus caused due to the collision with the obstacle.

It is an aspect of the present invention to provide an obstacle detection apparatus and method which can determine the posture of the obstacle detection apparatus after a collision with an obstacle by using an acceleration sensor.

Additional aspects and/or advantages of the invention will be set forth in part in the description which follows and, in part will be apparent from the description, or may be learned by practice of the invention.

The foregoing and/or other aspects of the present invention are achieved by providing an obstacle detection apparatus. The obstacle detection apparatus includes a main body which can be moved along a surface of the ground, a movement amount determination module which determines whether an amount of movement of the main body is outside a predefined threshold range, a posture determination module which determines the changed posture of the main body with respect to the surface of the ground according to the amount of movement of the main body, and a state determination module which determines the state of an obstacle according to the results of the determination performed by the movement amount determination module or according to the results of the determination performed by the posture determination module.

It is another aspect of the present invention to provide an obstacle detection method for controlling an obstacle detection apparatus including determining whether an amount of movement of a main body of the obstacle detection apparatus is outside a predefined threshold range, determining a changed posture of the main body with respect to a surface of the ground according to the amount of movement of the main body, and determining the state of an obstacle based upon the results of determining whether the amount of movement of the main body is outside of the predefined threshold or determining the changed posture of the main body.

It is another aspect of the present invention to provide a computer readable medium implementing a method of detecting an obstacle using an obstacle detection apparatus performed by a computer, the method including determining whether an amount of movement of a main body of the obstacle detection apparatus is outside a predefined threshold range, determining a changed posture of the main body with respect to a surface of the ground according to the amount of movement of the main body, and determining the state of an obstacle based on the results of determining whether the amount of movement of the main body is outside the predefined threshold range or determining the changed posture of the main body.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
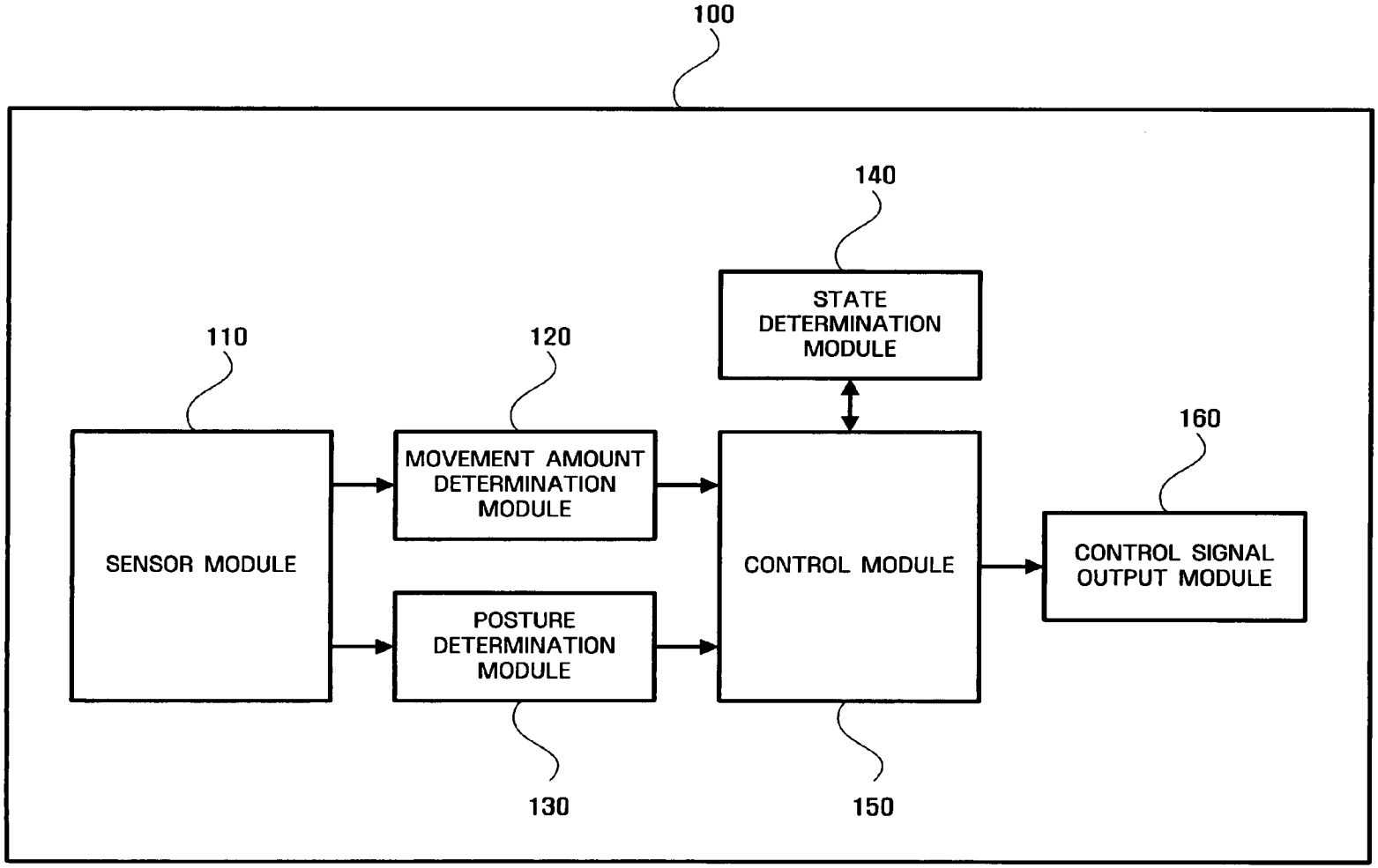
FIG. 1 is a block diagram of an obstacle detection apparatus according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures. The present invention may, however, be embodied in many different forms and should not be construed as being limited to the embodiments set forth herein.

FIG. 1 is a block diagram of an obstacle detection apparatus 100 according to an embodiment of the present invention. As shown in FIG. 1, the obstacle detection apparatus 100 comprises a sensor module 110, a movement amount determination module 120, a posture determination module 130, a state determination module 140, a control module 150, and a control signal output module 160.

The sensor module 110 detects a variation in an acceleration of the obstacle detection apparatus 100 when the obstacle detection apparatus 100 collides with an obstacle or when the posture of the obstacle detection apparatus 100 is changed using at least one sensor. For this, the sensor module 110 may comprise one or more acceleration sensors.

Assume that the X-axis is parallel to an axis of movement of the obstacle detection apparatus 100, the Y-axis is perpendicular to the X-axis, and the Z-axis is perpendicular to the surface of the ground. In this regard, the sensor module 110 comprises a plurality of sensors respectively corresponding to the X-axis, the Y-axis, and the Z-axis or alternatively comprises only one sensor corresponding to the X-axis.

Thus, alternatively, the sensor module 110 detects a variation in the acceleration of the obstacle detection apparatus 100 using only one sensor, for example. In order to detect a change in the posture of the obstacle detection apparatus 100, the sensor module 110 also comprises an angular velocity sensor or a gyro sensor, for example. Alternatively, the sensor module 110 comprises a velocity sensor instead of an acceleration sensor, for example. Thus, the present invention is not limited to any particular type or number of sensors, and may vary as necessary.

The movement amount determination module 120 determines whether the amount of movement of the obstacle detection apparatus 100 is within a predefined threshold range. The movement amount determination module 120 determines whether the amount of movement of the obstacle detection apparatus 100 is within the predefined threshold range by using a variation in the acceleration of the obstacle detection apparatus 100 that is detected in the direction of the movement of the obstacle detection apparatus 100 by the sensor module 110.

For example, when the obstacle detection apparatus 100 collides with the obstacle while traveling on a level ground, the acceleration of the obstacle detection apparatus 100 in the direction of the movement of the obstacle detection apparatus 100 considerably varies. the movement amount determination module 120 considers the variation in the acceleration of the obstacle detection apparatus 100 as the amount of movement of the obstacle detection apparatus 100, and determines whether the variation in the acceleration of the obstacle detection apparatus 100 is within the predefined threshold range.

If the sensor module 110 comprises a velocity sensor, the movement amount determination module 120 is continuously provided with velocity information of the obstacle detection apparatus 100 by the sensor module 110. Thus, the movement amount determination module 120 determines whether the amount of movement of the obstacle detection apparatus 100 is within the predefined threshold range by referencing a variation in the velocity of the obstacle detection apparatus 100 per unit time. The predefined threshold range is predetermined by a user.

The offset of the predefined threshold range is altered according to the posture of the obstacle detection apparatus 100. For example, assuming that a width of the predetermined range is 20, the predetermined range may be set between −10 and 10 for when the obstacle detection apparatus 100 travels on a level ground, and may be set between 40 and 60 for when the posture of the obstacle detection apparatus 100 is changed and the obstacle detection apparatus 100 travels with the changed posture. When the posture of the obstacle detection apparatus 100 is changed, the offset of the predefined threshold range is increased by 50. Accordingly, the movement amount determination module 120 determines whether a variation in the acceleration of the obstacle detection apparatus 100 is within a threshold range which is set according to the posture of the obstacle detection apparatus 100.

The offset of the predefined threshold range is determined according to whether an acceleration of the obstacle detection apparatus 100 detected by the sensor module 110 is maintained for a predetermined amount of time. For example, when the offset of the predefined threshold range is increased by 50, as described above, it appears that the acceleration of the obstacle detection apparatus 100 has been maintained at about 50 for a predetermined amount of time.

The posture determination module 130 determines the posture of the obstacle detection apparatus 100 with respect to the surface of the ground. Here, the posture determination module 130 determines the posture of the obstacle detection apparatus 100 based on a variation in the acceleration of the posture determination module 130 caused due to the influence of the gravitational acceleration.

For example, when a wheel or another portion of the obstacle detection apparatus 100 is laid over the obstacle as a result of a collision between the obstacle detection apparatus 100 and the obstacle, the obstacle detection apparatus 100 is tilted with respect to the surface of the ground. Then, the acceleration of the obstacle detection apparatus 100 measured along the X-axis, the Y-axis, and Z-axis by a plurality of acceleration sensors respectively corresponding to the X-axis, the Y-axis, and the Z-axis varies due to the influence of the gravitational acceleration. That is, the X-axis acceleration and the Y-axis acceleration of the obstacle detection apparatus 100 respectively measured by the X-axis sensor and the Y-axis acceleration sensor increase while the Z-axis acceleration of the obstacle detection apparatus 100 measured by the Z-axis acceleration sensor decreases.

Therefore, the posture determination module 130 determines the angle between the obstacle detection apparatus 100 and the surface of the ground by using a variation in the acceleration of the obstacle detection apparatus 100.

As described above, the sensor module 110 comprises an angular velocity sensor or a gyro sensor, for example. In this case, the posture determination module 130 determines the posture of the obstacle detection apparatus 100 using angular velocity information or direction information provided by the angular velocity sensor or the gyro sensor.

The control module 150 determines whether the situation when the amount of movement of the obstacle detection apparatus 100 is determined to be outside the predefined threshold range or the situation when a change in the posture of the obstacle detection apparatus 100 is detected is caused by the collision between the obstacle detection apparatus 100 and the obstacle. In other words, the amount of movement of the obstacle detection apparatus 100 is detected to be outside the predefined threshold range or a change in the posture of the obstacle detection apparatus 100 is detected in situations other than the situation when the obstacle detection apparatus 100 collides with the obstacle. Thus, if the control module 150 determines that the obstacle detection apparatus 100 has collided with the obstacle when the amount of movement of the obstacle detection apparatus 100 is detected to be outside the predefined threshold range or when a variation in the acceleration of the obstacle detection apparatus 100 occurs, the obstacle detection apparatus 100 malfunctions.

In order to determine whether the obstacle detection apparatus 100 has collided with the obstacle, the control module 150 uses a difference between the time when a front wheel of the obstacle detection apparatus 100 hits the obstacle and the time when a rear wheel of the obstacle detection apparatus 100 hits the obstacle.

For example, when the obstacle detection apparatus 100 collides with the obstacle while traveling on a level ground. If the height of the obstacle is low, the obstacle detection apparatus 100 may be able to override the obstacle. In this case, the control module 150 determines that the obstacle detection apparatus 100 has collided with the obstacle when a difference between the time when a front wheel of the obstacle detection apparatus 100 collides with the obstacle and the time when a rear wheel of the obstacle detection apparatus 100 collides with the obstacle is equal to a predetermined effective time difference.

The control module 150 controls an operation of the obstacle detection apparatus 100 by controlling the sensor module 110, the movement amount determination module 120, the posture determination module 130, the state determination module 140, and the control signal output module 160.

The state determination module 140 determines a state of the obstacle when the amount of movement of the obstacle detection apparatus 100 is outside the predefined threshold range or when the posture of the obstacle detection apparatus 100 is changed due to a collision with the obstacle. In other words, when the control module 150 determines that the obstacle detection apparatus 100 has collided with the obstacle, the control module 150 receives state information of the obstacle detection apparatus 100 from the posture determination module 130, and transmits the received state information to the state determination module 140, thereby enabling the state determination module 130 to determine the state of the obstacle.

Here, the state of the obstacle determined by the state determination module 140 comprises the location, size, and height of the obstacle. The state determination module 140 determines the location of the obstacle by extracting the coordinates of the obstacle when receiving the state information transmitted by the control module 150.

When two collisions are detected after the collision between the obstacle detection apparatus 100 and the obstacle, it is determined that the obstacle detection apparatus 100 has left the obstacle. In this manner, the state determination module 140 determines the size of the obstacle, and determines the height of the obstacle according to information transmitted by the control module 150 regarding the posture of the obstacle detection apparatus 100.

The control signal output module 160 outputs a control signal according to the posture of the obstacle detection apparatus 100 determined by the posture determination module 130 and the state of the obstacle determined by the state determination module 140.

For example, assume that the obstacle detection apparatus 100 is a cleaning robot. When a front wheel of the obstacle detection apparatus 100 is laid over the obstacle, the distance between a suction inlet and the surface of the ground increases. Thus, the control signal output module 160 outputs a control signal for increasing suction. When the obstacle detection apparatus 100 approaches the obstacle, the control signal output module 160 outputs a control signal for changing a traveling path of the obstacle detection apparatus 100 with reference to the location of the obstacle determined by the state determination module 140 so that the obstacle detection apparatus 100 takes a detour to avoid the obstacle.

Figure 2:
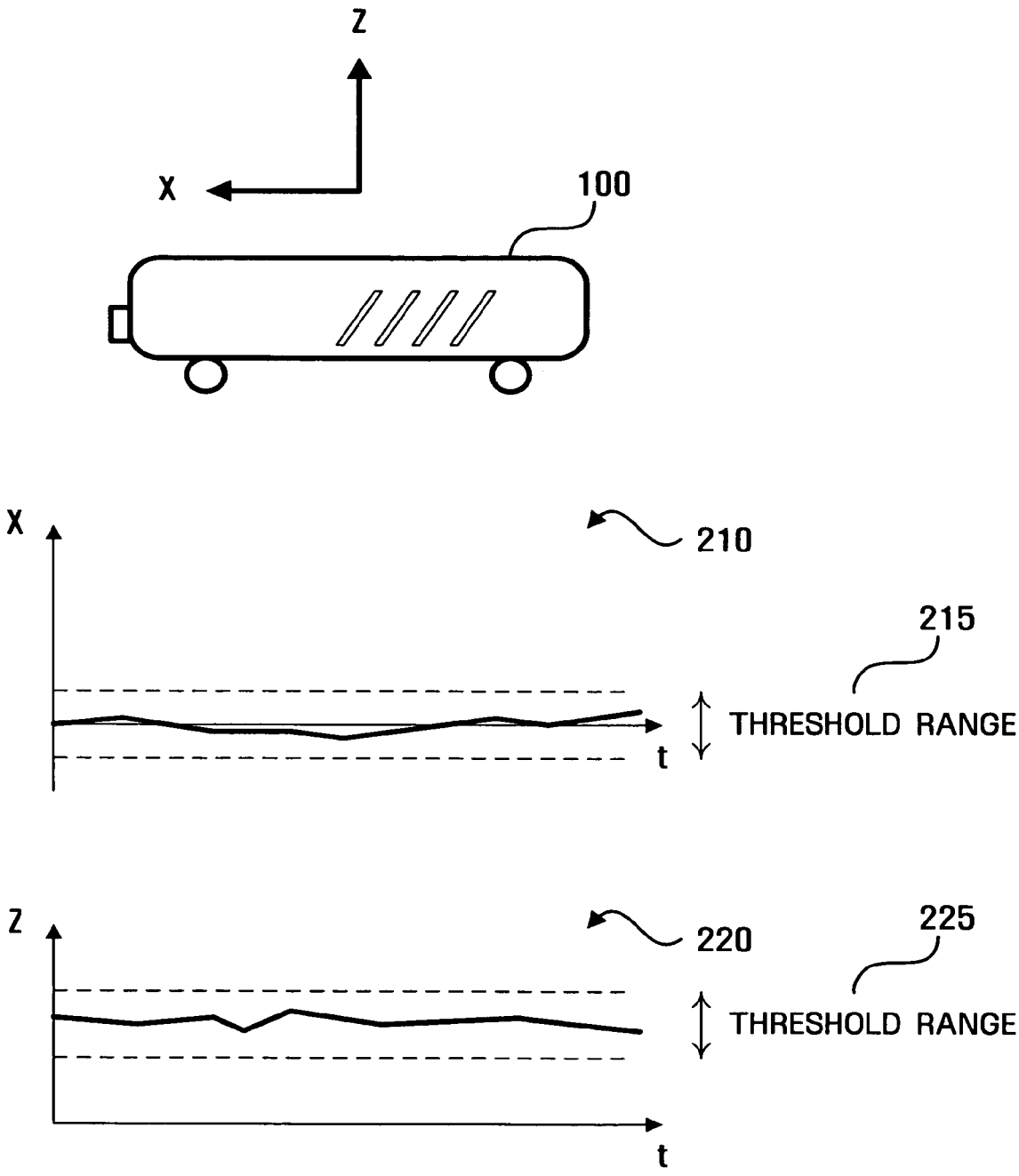
FIG. 2 is a diagram for illustrating when the obstacle detection apparatus illustrated in FIG. 1 travels on the ground.

FIG. 2 is a diagram for illustrating when the obstacle detection apparatus 100 illustrated in FIG. 1 travels on the ground. Referring to FIG. 2, the obstacle detection apparatus 100, like a cleaning robot, comprises a driving module and a plurality of wheels.

The obstacle detection apparatus 100 travels along a traveling path determined according to a predetermined algorithm. As described above, assume that a spatial axis corresponding to the traveling direction of the obstacle detection apparatus 100 is the X-axis and that a spatial axis perpendicular to the surface of the ground is the Z-axis.

Even when the obstacle detection apparatus 100 travels on a level ground, the sensor module 110 detects fluctuations in the acceleration of the obstacle detection apparatus 100 because of various external factors. However, variations in the acceleration of the obstacle detection apparatus 100 while the obstacle detection apparatus 100 travels on a level ground are generally inconsiderable, and thus always fall within a predefined threshold range 215 or 225. As indicated by reference numerals 210 and 220, the variation in the X-axis acceleration of the obstacle detection apparatus 100 and the variation in the Z-axis acceleration of the obstacle detection apparatus 100 are slightly different but are respectively within the predefined threshold ranges 215 and 225 all the time.

However, when the obstacle detection apparatus 100 collides with the obstacle while traveling on a level ground, the acceleration of the obstacle detection apparatus 100 considerably varies, and this will hereinafter be described in detail with reference to FIG. 3.

Figure 3:
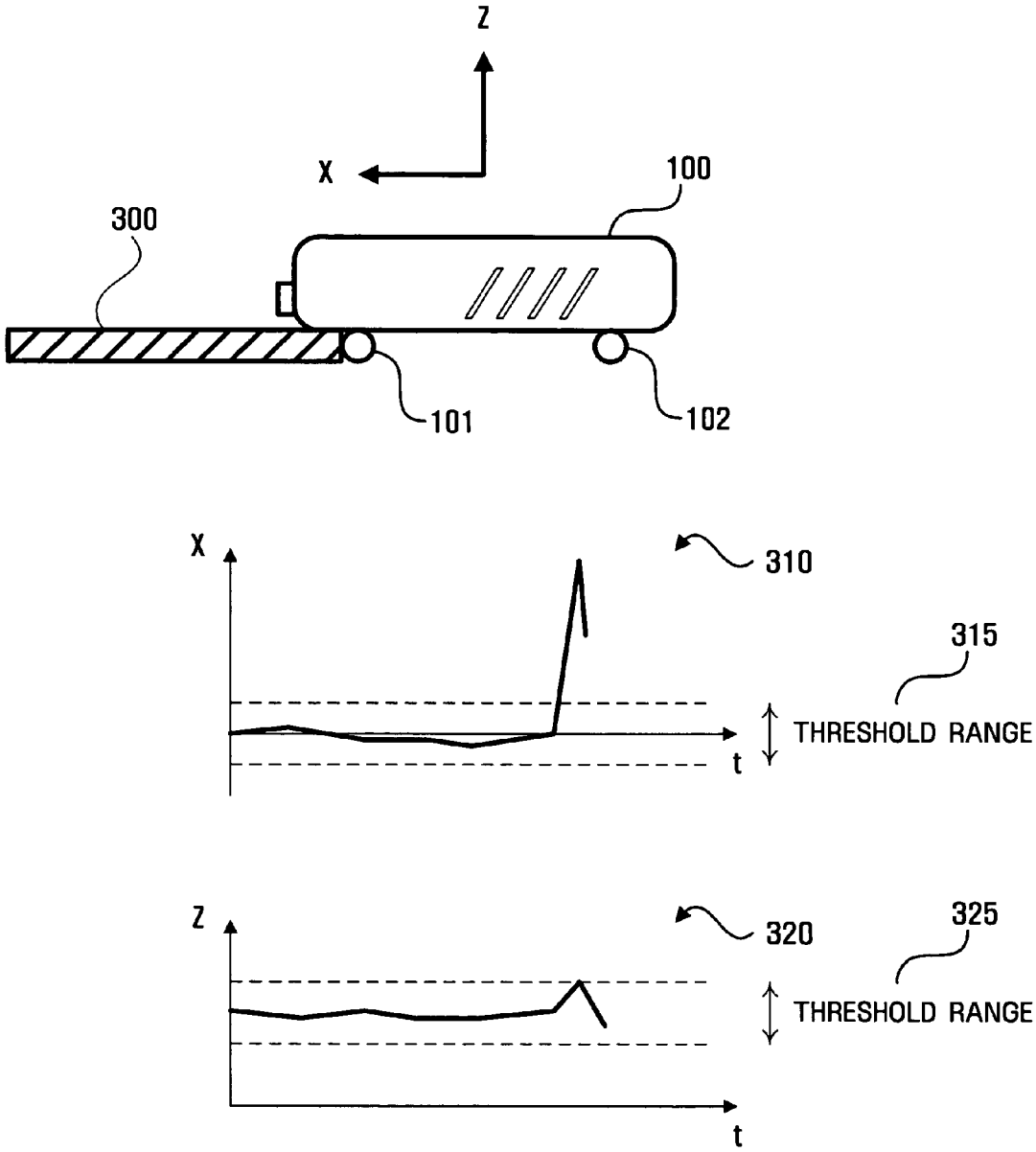
FIG. 3 is a diagram for illustrating when the obstacle detection apparatus illustrated in FIG. 1 collides with an obstacle while traveling on a level ground.

FIG. 3 is a diagram for illustrating when the obstacle detection apparatus 100 illustrated in FIG. 1 collides with an obstacle 300. As shown in FIG. 3, a front wheel 101 of the obstacle detection apparatus 100 hits a lateral side of the obstacle 300.

Once the obstacle detection apparatus 100 collides with the obstacle 300, the velocity of the obstacle detection apparatus 100 rapidly decreases. Accordingly, the X-axis acceleration of the obstacle detection apparatus 100 drastically increases, and the Z-axis acceleration of the obstacle detection apparatus 100 also increases, but less drastically, due to vibration caused by the collision with the obstacle 300.

As indicated by reference numerals 310 and 320, an X-axis peak acceleration of the obstacle detection apparatus 100 is outside a predefined threshold range 315, while a Z-axis peak acceleration of the obstacle detection apparatus 100 is still within a predefined threshold range 325. The X-axis acceleration of the obstacle detection apparatus 100 measured by the sensor module 110 when the obstacle detection apparatus 100 collides with the obstacle 300 is transmitted to the movement amount determination module 120. Then, the movement amount determination module 120 determines that the acceleration of the obstacle detection apparatus 100 when the obstacle detection apparatus 100 collides with the obstacle 300 is outside the predefined threshold range 315 or 325.

Figure 4:
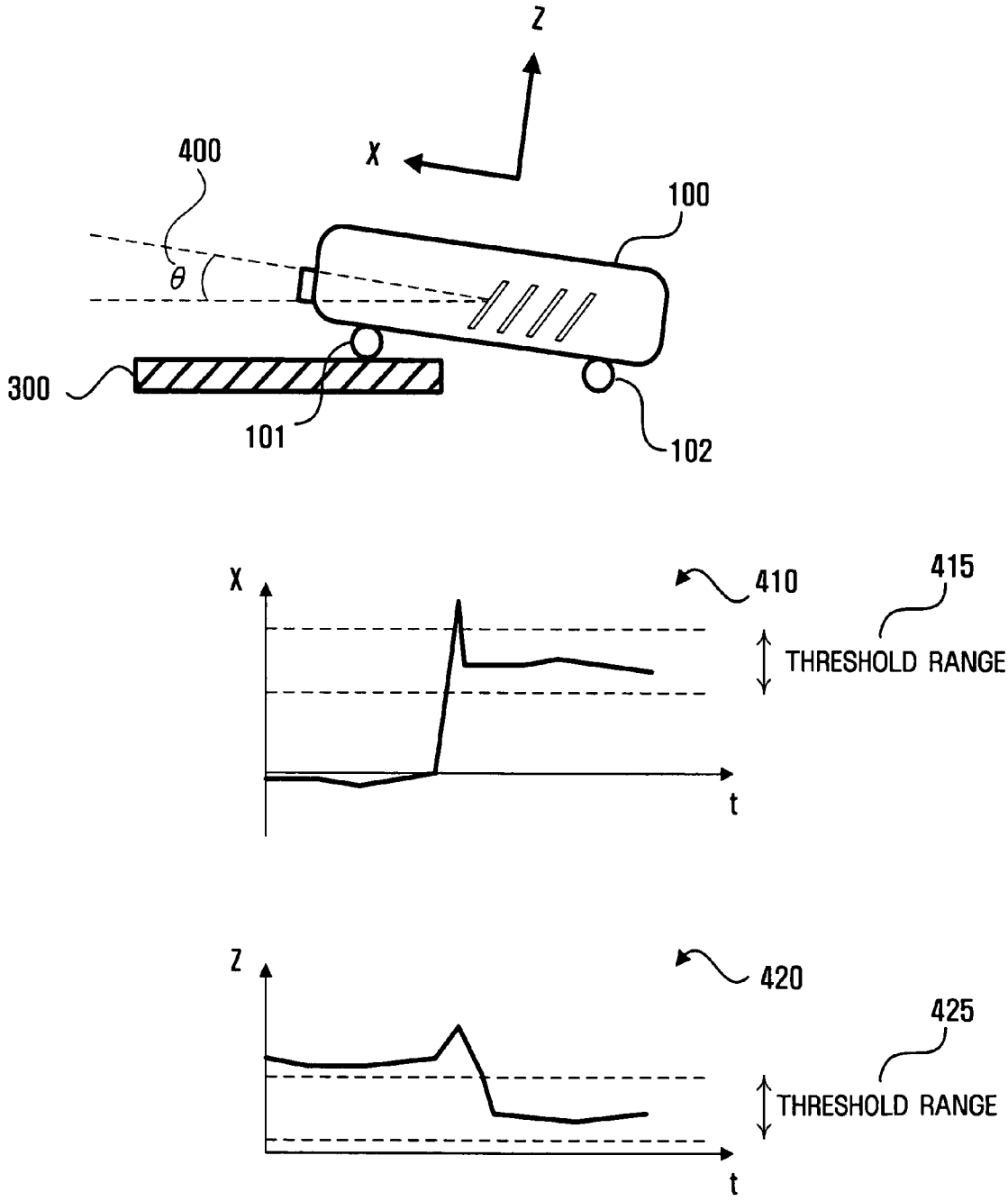
FIG. 4 is a diagram for illustrating a changed posture of the obstacle detection apparatus illustrated in FIG. 1 due to a collision with an obstacle.

FIG. 4 is a diagram for illustrating when the posture of the obstacle detection apparatus 100 is changed due to the collision with the obstacle 300. As shown in FIG. 4, when the driving unit of the obstacle detection apparatus 100 continuously operates even after the obstacle detection apparatus 100 collides with the obstacle 300 and the height of the obstacle 300 is relatively low, the front wheel 101 of the obstacle detection apparatus 100 can override the obstacle 300. In this case, the obstacle detection apparatus 100 keeps traveling when the front wheel 101 is off the ground and laid over the obstacle 300 and a rear wheel 102 is still on the ground.

The posture determination module 130 determines whether the posture of the obstacle detection apparatus 100 has been changed by referencing the angle θ between the obstacle detection apparatus 100 and the surface of the ground(i.e., a pitch 400). The sensor module 110 keeps measuring the acceleration of the obstacle detection apparatus 100 and transmits the results of the measuring to the posture determination module 130. Then, the posture determination module 130 calculates the pitch 400' based on a variation in the acceleration of the obstacle detection apparatus 100.

In order to calculate the pitch 400, the posture determination module 130 references at least one of, for example, a variation in the X-axis acceleration of the obstacle detection apparatus 100 and a variation in the Z-axis acceleration of the obstacle detection apparatus 100 detected by the sensor module 110.

When the posture of the obstacle detection apparatus 100 is changed, the X-axis acceleration and the Z-axis acceleration of the obstacle detection apparatus 100 both vary. In detail, since the X-axis is parallel to the surface of the ground, the X-axis acceleration of the obstacle detection apparatus 100 is normally not affected by the gravitational acceleration and thus approximates zero. However, once the posture of the obstacle detection apparatus 100 is changed so that the X-axis is no longer parallel to the surface of the ground, the X-axis acceleration of the obstacle detection apparatus 100 is affected by the gravitational acceleration and thus increases proportionally to the pitch 400.

On the other hand, since the Z-axis is perpendicular to the surface of the ground, the Z-axis acceleration of the obstacle detection apparatus 100 is normally almost the same as the gravitational acceleration. However, once the posture of the obstacle detection apparatus 100 is changed so that the Z-axis is no longer perpendicular to the surface of the ground, the Z-axis acceleration of the obstacle detection apparatus 100 is less affected by the gravitational acceleration and thus decreases proportionally to the pitch 400.

Reference numerals 410 and 420 respectively represent variations in the X-axis acceleration of the obstacle detection apparatus 100 and variations in the Z-axis acceleration of the obstacle detection apparatus 100. As indicated by reference numerals 410 and 420, when the posture of the obstacle detection apparatus 100 is changed and the obstacle detection apparatus 100 keeps traveling with the changed posture, the X-axis acceleration of the obstacle detection apparatus 100 maintains to be higher than usual, and the Z-axis acceleration of the obstacle detection apparatus 100 maintains to be lower than usual. Information regarding the acceleration of the obstacle detection apparatus 100 after the posture of the obstacle detection apparatus 100 is changed is transmitted to the posture determination module 130, and the posture determination module 130 calculates the pitch 400 based on a difference between the acceleration of the obstacle detection apparatus 100 before the posture of the obstacle detection apparatus 100 is changed and the acceleration of the obstacle detection apparatus 100 after the posture of the obstacle detection apparatus 100.

The result of the calculation performed by the posture determination module 130 is transmitted to the state determination module 140, and the state determination module 140 calculates the height of the obstacle based on the pitch 400.

Figure 5:
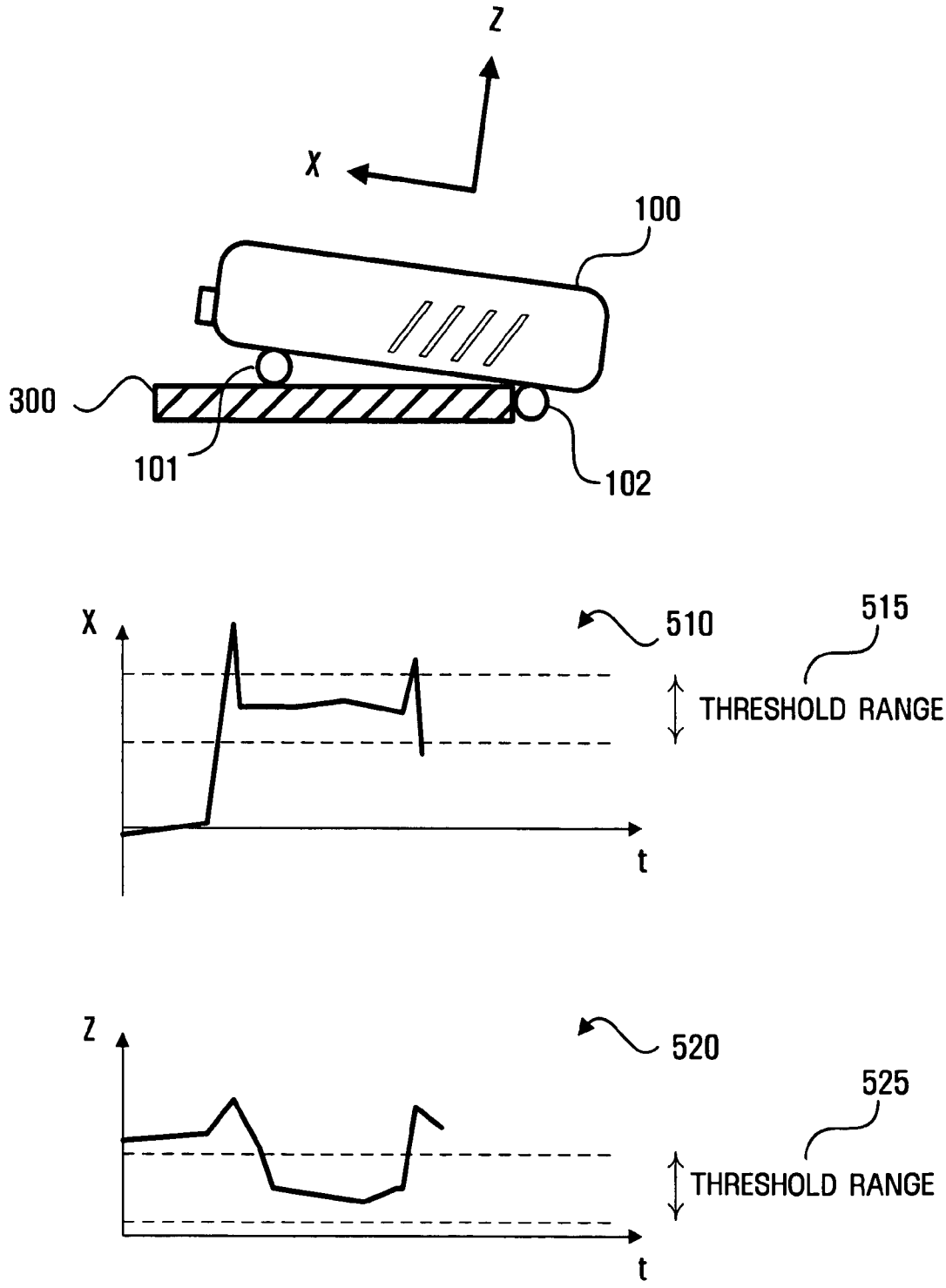
FIG. 5 is a diagram for illustrating when a rear wheel of the obstacle detection apparatus illustrated in FIG. 1 hits an obstacle.

FIG. 5 is a diagram for illustrating when the rear wheel 102 of the obstacle detection apparatus 100 illustrated in FIG. 1 hits the obstacle 300. As shown in FIG. 5, when the rear wheel 102 of the obstacle detection apparatus 100 hits the obstacle 300, the velocity of the obstacle detection apparatus 100 drastically decreases as in the situation when the front wheel 101 of the obstacle detection apparatus 100 hits the obstacle 300. Accordingly, the X-axis acceleration of the obstacle detection apparatus 100 drastically increases, and the Z-axis acceleration of the obstacle detection apparatus 100 also increases, but less drastically, due to vibration caused by the collision with the obstacle 300.

As indicated by reference numerals 510 and 520, an X-axis peak acceleration and a Z-axis peak acceleration of the obstacle detection apparatus 100 are detected when the rear wheel 102 hits the obstacle 300. Once the front wheel 101 of the obstacle detection apparatus 100 hits the obstacle 300, the obstacle detection apparatus 100 travels at a lower speed than usual. Thus, the amount by which the acceleration of the obstacle detection apparatus 100 is varied due to the collision between the rear wheel 102 and the obstacle 300 is less than the amount by which the acceleration of the obstacle detection apparatus 100 is varied due to the collision between the front wheel 101 and the obstacle 300.

An impact against the obstacle detection apparatus 100 may not necessarily be interpreted as a collision between the obstacle detection apparatus 100 and the obstacle 300. For example, the obstacle detection apparatus 100 may detect an impact when the obstacle detection apparatus 100 collides with a user's foot. However, if the user places his/her foot away from the obstacle detection apparatus 100, the obstacle detection apparatus 100 may not be able to detect another impact afterwards.

In addition, when the user treads on the obstacle detection apparatus 100 or when the user lifts up the obstacle detection apparatus 100, the obstacle detection apparatus 100 detects an impact or acceleration. However, the obstacle detection apparatus 100 may not detect any impact or acceleration afterwards.

On the contrary, when the obstacle detection apparatus 100 collides with a fixed obstacle such as the obstacle 300, as illustrated in FIGS. 2 through 5, the obstacle detection apparatus 100 is able to detect an impact twice when the front wheel 101 hits the obstacle 300 and when the rear wheel 102 hits the obstacle 300.

The control module 150 determines whether the obstacle detection apparatus 100 has collided with the obstacle 300 or another object by referencing a difference between the time when the front wheel 101 hits the obstacle 300 and the time when the rear wheel 102 hits the obstacle 300, the velocity of the obstacle detection apparatus 100, and the distance between the front wheel 101 and the rear wheel 102 of the obstacle detection apparatus 100.

A difference between the time when the front wheel 101 passes through a predetermined point and the time when the rear wheel 102 passes through the predetermined point can be calculated based on the distance between the front wheel 101 and the rear wheel 102 and the velocity of the obstacle detection apparatus 100. The control module 150 determines whether the obstacle detection apparatus 100 has collided with the obstacle 300 or another object by determining whether the result of the calculation is similar to a predetermined effective time difference.

Before the rear wheel 102 hits the obstacle 300, one or more minor peak accelerations may be detected according to the state of the surface of the ground or the state of the surface of the obstacle 300. However, the control module 150 can ignore these minor peak accelerations by using the predetermined effective time difference.

Once the control module 150 determines that a current impact against the obstacle detection apparatus 100 is caused by the collision between the obstacle detection apparatus 100 and the obstacle 300, the state determination module 140 determines the state of the obstacle 300, and particularly, the location, size, and height of the obstacle 300.

Figure 6:
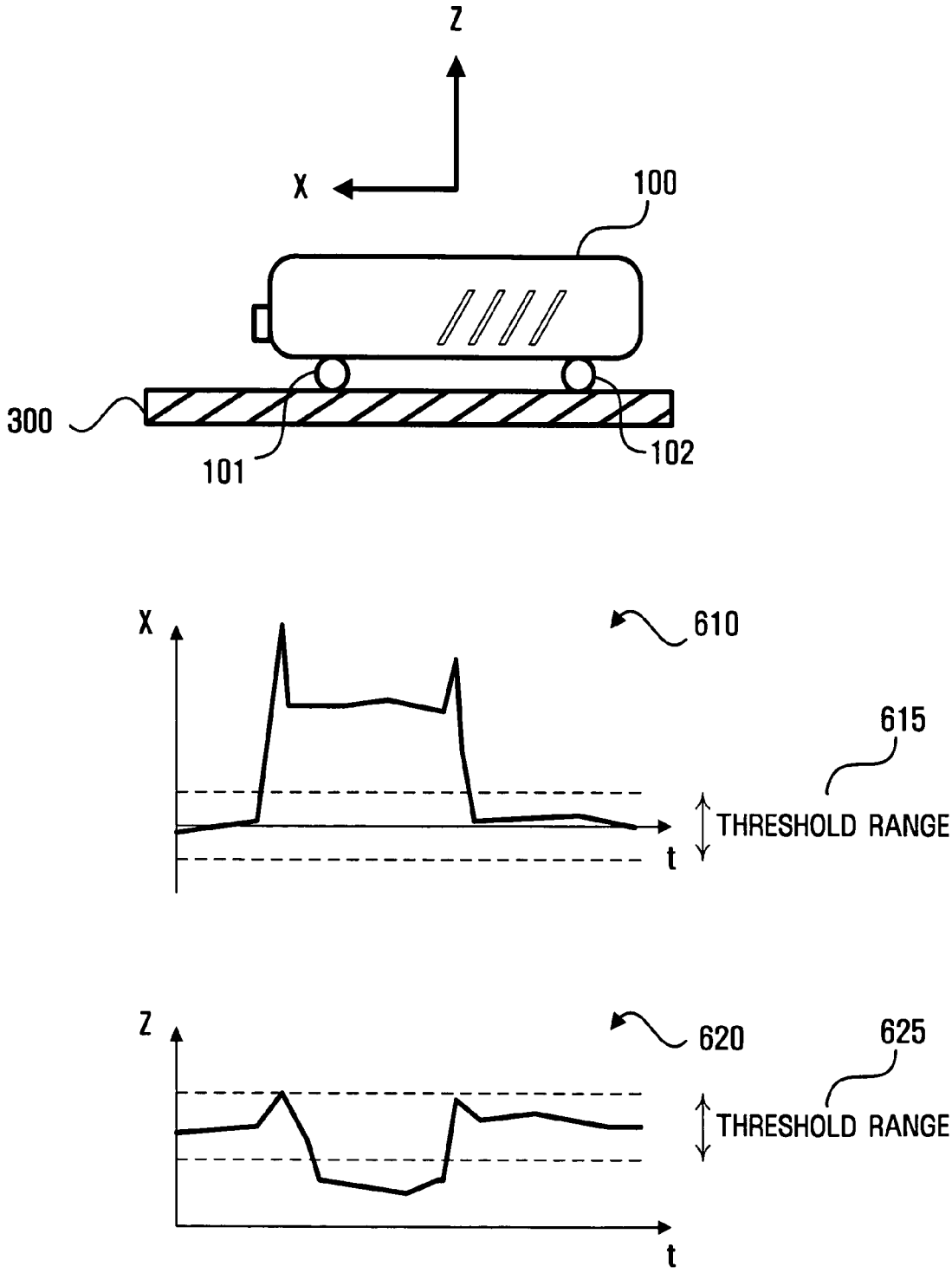
FIG. 6 is a diagram for illustrating the obstacle detection apparatus illustrated in FIG. 1 returns to its original posture.

FIG. 6 is a diagram for illustrating the situation when the front wheel 101 and the rear wheel 102 of the obstacle detection apparatus 100 are both laid over the obstacle 300 and thus the obstacle detection apparatus 100 illustrated in FIG. 1 returns to its original posture. As indicated by reference numerals 610 and 620, once the obstacle detection apparatus 100 resumes its original posture, the X-axis acceleration and the Z-axis acceleration of the obstacle detection apparatus 100 are respectively within a threshold range 615 and a threshold range 625 as in the situation before the obstacle detection apparatus 100 collides with the obstacle 300.

Figure 7:
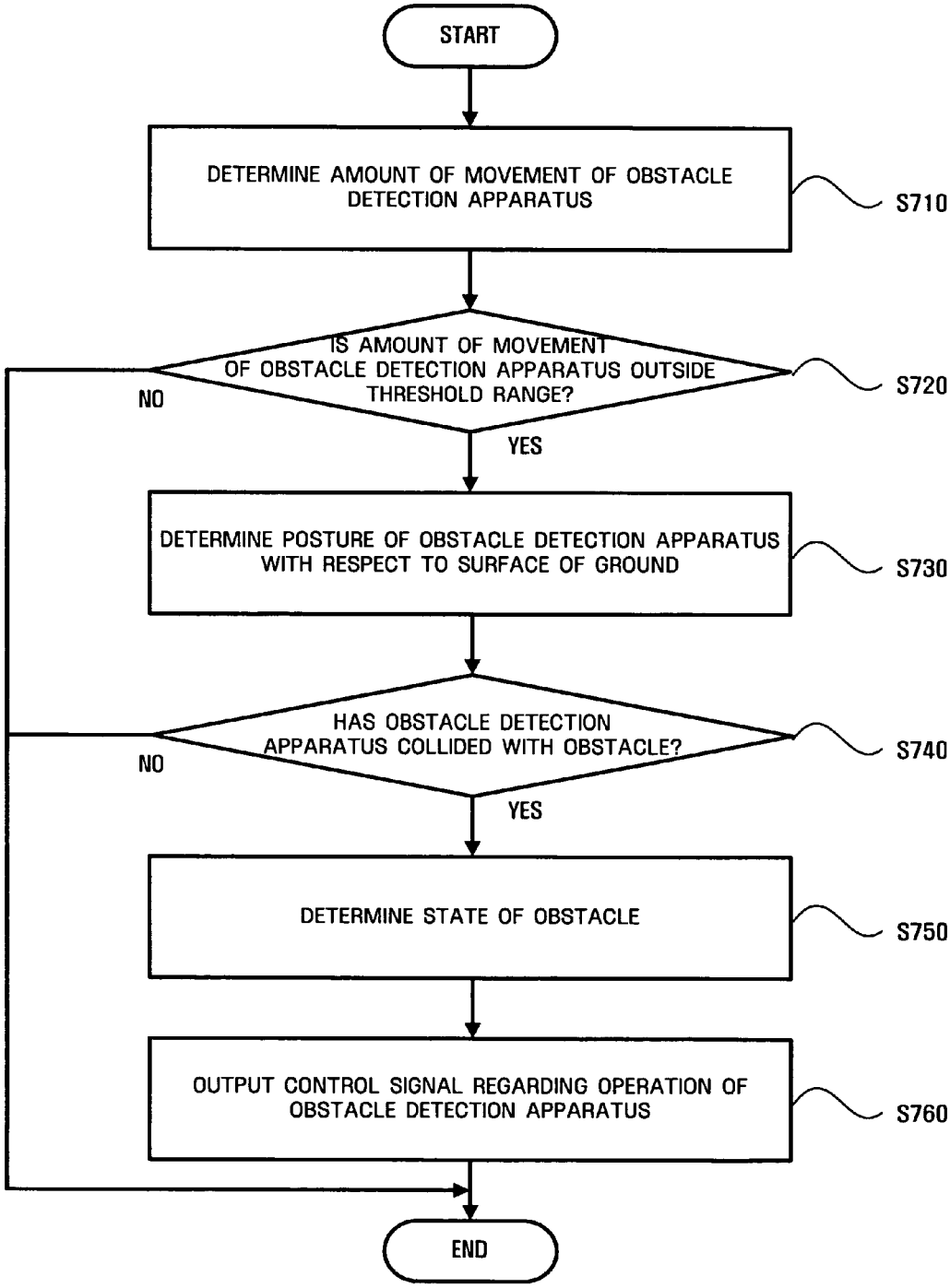
FIG. 7 is a flowchart illustrating an obstacle detection method according to an embodiment of the present invention.

FIG. 7 is a flowchart illustrating an obstacle detection method according to an embodiment of the present invention. As shown in FIG. 7, in operation 710, the sensor module 110 of the obstacle detection apparatus 100 uses one or more sensor to detect movement of the obstacle detection apparatus 100 caused by a collision with the obstacle 300 or a change in the posture of the obstacle detection apparatus 100.

Here, the movement of the obstacle detection apparatus 100 comprises a variation in the acceleration of the obstacle detection apparatus 100. In order to detect a variation in the acceleration of the obstacle detection apparatus 100, the sensor module 110 may use one or more acceleration sensor. Alternatively, the sensor module 110 detects the angular velocity, direction, or velocity of the obstacle detection apparatus 100 using an angular velocity sensor, a gyro sensor, or a velocity sensor, for example.

A movement amount signal obtained by the detection performed in operation 710 comprises noise generated due to various external factors. Accordingly, the sensor module 110 comprises a low pass filter or a band pass filter to remove noise from the movement amount signal.

In operation 720, the result of the detection performed in operation 710 is transmitted to the movement amount determination module 120 and the posture determination module 130, and the movement amount determination module 120 determines whether the amount of movement of the obstacle detection apparatus 100 is outside a predefined threshold range. When the obstacle detection apparatus 100 collides with the obstacle 300 while traveling on a level ground, the amount of movement of the obstacle detection apparatus 100 is outside the predefined threshold range. Thus, when the amount of movement of the obstacle detection apparatus 100 is determined in operation 720 to be outside the predefined threshold range, the movement amount determination module 120 transmits the result of the detection performed in operation 710 to the control module 150.

In operation 730, the posture determination module 130 is provided with the result of the detection performed in operation 710, and determines the posture of the obstacle detection apparatus 100 with respect to the surface of the ground. When the obstacle detection apparatus 100 is parallel to the surface of the ground, the amount of movement of the obstacle detection apparatus 100 along the X-axis approximates zero. On the other hand, when the obstacle detection apparatus 100 is tilted with respect to the surface of the ground, the amount of movement of the obstacle detection apparatus 100 along the X-axis may not be zero. Given all this, the posture determination module 130 determines the posture of the obstacle detection apparatus 100 based on the amount of movement of the obstacle detection apparatus 100.

The posture determination module 130 determines the angle between the obstacle detection apparatus 100 and the surface of the ground, and the result of the determination is provided to the control module 150.

In operation 740, the control module 150 is provided with the result of the detection performed in operation 710 and the result of the determination performed in operation 730 and determines whether the amount of movement of the obstacle detection apparatus 100 is determined to be outside the predefined threshold range or a change in the posture of the obstacle detection apparatus 100 is detected, is caused by the collision between the obstacle detection apparatus 1.00 and the obstacle 300 by referencing the result of the detection performed in operation 710 and the result of the determination performed in operation 730.

The control module 150 uses a difference between the time when the front wheel 101 of the obstacle detection apparatus 100 hits the obstacle 300 and the time when the rear wheel 102 of the obstacle detection apparatus 100 hits the obstacle 300, the velocity of the obstacle detection apparatus 100, and the distance between the front wheel 101 and the rear wheel 102(as described above).

In operation 750, when the control module 150 determines that the obstacle detection apparatus 100 has collided with the obstacle 300, the result of the detection performed in operation 710, and the result of the determination performed in operation 730 are transmitted to the state determination module 140, and the state determination module 140 determines the state of the obstacle 300 by referencing the result of the detection performed in operation 710, and the result of the determination performed in operation 730. The state of the obstacle 300 determined by the state determination module 140 may include the location, width, and height of the obstacle 300.

In operation S60, the result of the examination performed in operation 750 is transmitted to the control module 150, and the control module 150 controls the control signal output module 160 to output a control signal regarding the operation of the obstacle detection apparatus 100.

It will be understood that each operation of the flowchart, and combinations of operations in the flowchart, can be implemented by computer program instructions. These computer program instructions may also be stored in a computer usable or computer-readable memory that can direct a computer or other programmable data processing apparatus to function in a particular manner, such that the instructions stored in the computer usable or computer-readable memory produce an article of manufacture including instruction means that implement the function specified in the flowchart block or blocks.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide a method for implementing the functions specified in the flowchart operation(s).

And each operation of the flowchart illustrations may represent a module, segment, or portion of code, which comprises one or more executable instructions for implementing the specified logical function(s). It should also be noted that in some alternative implementations, the functions noted in the operations may occur in a different order. For example, two operations shown in succession may in fact be executed substantially concurrently or the operations may sometimes be executed in the reverse order, depending upon the functionality involved.

As described above, the obstacle detection apparatus and method according to the present invention have the following advantages.

First, the obstacle detection apparatus and method according to an embodiment of the present invention can determine the state of an obstacle according to a signal generated when the obstacle detection apparatus collides with the obstacle and a change in the posture of the obstacle detection apparatus caused due to the collision with the obstacle.

Second, the obstacle detection apparatus and method according to an embodiment of the present invention can determine a collision with an obstacle and a change in the posture of the obstacle detection apparatus using only one acceleration sensor, thereby reducing the manufacturing costs.

Although a few embodiments of the present invention have been shown and described, it would be appreciated by those of ordinary skill in the art that changes may be made in these embodiments without departing from the principles and spirit of the t invention, the scope of which is defined in the claims and their equivalents.

What is claimed is:

1. An obstacle detection apparatus comprising:

a main body which can be moved along a surface of the ground;

a posture determination module which determines a changed posture of the main body with respect to a surface of the ground;

a movement amount determination module which determines whether an amount of movement of the main body is outside a predefined threshold range, and which varies an offset of the predefined threshold range according to results of the determination performed by the posture determination module; and a state determination module which determines a state of an obstacle according to results of the determination performed by the movement amount determination module and according to results of the determination performed by the posture determination module.

2. The obstacle detection apparatus of claim 1, wherein the amount of movement of the main body comprises a variation in acceleration, angular velocity, velocity, or direction of the main body.

3. The obstacle detection apparatus of claim 1 further comprising:

a sensor module which detects the amount of movement of the main body using at least one sensor.

4. The obstacle detection apparatus of claim 3, wherein the movement amount determination module determines whether a variation in the acceleration of the main body detected in the direction of movement of the main body by the sensor module is outside the predefined threshold range.

5. The obstacle detection apparatus of claim 3, wherein the posture determination module determines the changed posture of the main body by referencing a variation in the gravitational acceleration detected by the sensor module.

6. The obstacle detection apparatus of claim 1, wherein, when the main body maintains the changed posture for a predetermined amount of time, the movement amount determination module determines an offset of the predefined threshold range according to the amount of movement of the main body.

7. The obstacle detection apparatus of claim 1 further comprising a control module which determines whether when the amount of movement of the main body is determined to be outside the predefined threshold range or when a change in the posture of the main body is detected, is caused by a collision between the main body and the obstacle.

8. The obstacle detection apparatus of claim 7, wherein the control module determines when the amount of movement of the main body is determined to be outside the predefined threshold range or when a change in the posture of the main body is detected, is caused by a collision between the main body and the obstacle by using a difference between the time when a front wheel of the main body hits the obstacle and the time when a rear wheel of the main body hits the obstacle.

9. The obstacle detection apparatus of claim 1, wherein the state of the obstacle comprises the location, width, and height of the obstacle.

10. An obstacle detection method for controlling an obstacle detection apparatus, the method comprising:

determining a changed posture of a main body of the obstacle detection apparatus with respect to a surface of the ground determining whether an amount of movement of the main body is outside a predefined threshold range, and varying an offset of the predefined threshold range according to results of the determination performed by the posture determination module; and determining a state of an obstacle based on results of determining whether the amount of movement of the main body is outside the predefined threshold range and determining the changed posture of the main body.

11. The obstacle detection method of claim 10, wherein the amount of movement of the main body comprises a variation in the acceleration, angular velocity, velocity, or direction of the main body.

12. The obstacle detection method of claim 10 further comprising:

detecting the amount of movement of the main body using at least one sensor.

13. The obstacle detection method of claim 12, wherein the detecting comprises determining whether a variation in the acceleration of the main body detected in the direction of movement of the main body by the sensors is outside the predefined threshold range.

14. The obstacle detection method of claim 12, wherein the determining the changed posture of the main body comprises determining the changed posture of the main body using a variation in the gravitational acceleration detected by the sensors.

15. The obstacle detection method of claim 10, wherein the determining the changed posture of the main body comprises determining the offset of the predefined threshold range according to the amount of movement of the main body when the main body maintains the changed posture for a predetermined amount of time.

16. The obstacle detection method of claim 10 further comprising:

determining whether when the amount of movement of the main body is determined to be outside the predefined threshold range or when a change in the posture of the main body is detected, is caused by a collision between the main body and the obstacle.

17. The obstacle detection method of claim 16, further comprises:

determining whether when the amount of movement of the main body is determined to be outside the predefined threshold range or when a change in the posture of the main body is detected, is caused by a collision between the main body and the obstacle by using a difference between the time when a front wheel of the main body hits the obstacle and the time when a rear wheel of the main body hits the obstacle.

18. The obstacle detection method of claim 10, wherein the state of the obstacle comprises a location, width, and height of the obstacle.

19. A computer readable medium implementing a method of detecting an obstacle using an obstacle detection apparatus performed by a computer, the method comprising:

determining a changed posture of a main body of the obstacle detection apparatus with respect to a surface of the ground;

determining whether an amount of movement of the main body is outside a predefined threshold range, and which varies an offset of the predefined threshold range according to results of the determination performed by the posture determination module; and determining a state of an obstacle based on results of determining whether the amount of movement of the main body is outside the predefined threshold range and determining the changed posture of the main body.

20. The computer readable medium of claim 19, wherein the amount of movement of the main body comprises a variation in the acceleration, angular velocity, velocity, or direction of the main body.

21. The computer readable medium of claim 20, further comprises:

determining whether a variation in the acceleration of the main body detected in the direction of movement of the main body by the sensors is outside the predefined threshold range.

22. The computer readable medium of claim 19, further comprising:

detecting the amount of movement of the main body using at least one sensor.

23. The computer readable medium of claim 19, wherein the determining the changed posture of the main body comprises determining the changed posture of the main body using a variation in the gravitational acceleration detected by the sensors.

24. The computer readable medium of claim 19, wherein the determining the changed posture of the main body comprises determining an offset of the predefined threshold range according to the amount of movement of the main body when the main body maintains the changed posture for a predetermined amount of time.

25. The computer readable medium of claim 19, further comprising:

determining whether the amount of movement of the main body is determined to be outside the predefined threshold range or a change in the posture of the main body is detected is caused by a collision between the main body and the obstacle.

26. The computer readable medium of claim 25, further comprises:

determining whether the amount of movement of the main body is determined to be outside the predefined threshold range or the change in the posture of the main body is detected is caused by a collision between the main body and the obstacle by using a difference between the time when a front wheel of the main body hits the obstacle and the time when a rear wheel of the main body hits the obstacle.

27. The computer readable medium of claim 19, wherein the state of the obstacle comprises a location, width, and height of the obstacle.

28. A cleaning robot having an obstacle detection function, the cleaning robot comprising:

a main body moving along a group surface;

a movement amount determination module determining whether an amount of movement of the main body is outside a predefined threshold range;

a posture determination module determining a changed posture of the main body with respect to the ground surface according to the amount of movement of the main body;

a state determination module determining a state of an obstacle according to the results of the determination performed by the movement amount determination module and according to the results of the determination performed by the posture determination module; and a control signal output module variably adjusting a cleaning intensity of the cleaning robot according to the determination made by the state determination module.

29. The obstacle detection apparatus of claim 28, further comprising:

a movement amount unit to determine whether an amount of movement of the obstacle detection apparatus is within a predefined threshold range by using the variation in the acceleration of the obstacle detection apparatus detected.

30. The obstacle detection apparatus of claim 29, wherein the predefined threshold range is predetermined by a user.

* * * * *